US010329843B2

(12) United States Patent
Reboul et al.

(10) Patent No.: US 10,329,843 B2
(45) Date of Patent: Jun. 25, 2019

(54) FIXED CUTTER DRILL BIT HAVING CORE RECEPTACLE WITH CONCAVE CORE CUTTER

(71) Applicant: VAREL EUROPE S.A.S., Pau (FR)

(72) Inventors: Sebastien Reboul, Pau (FR); Bruno Cuillier De Maindreville, Pau (FR); Alfazazi Dourfaye, Paris (FR); Gilles Gallego, Ibos (FR)

(73) Assignee: VAREL EUROPE S.A.S., Pau (FR)

( * ) Notice: Subject to any disclaimer, the term of this patent is extended or adjusted under 35 U.S.C. 154(b) by 178 days.

(21) Appl. No.: 15/585,343

(22) Filed: May 3, 2017

(65) Prior Publication Data

US 2017/0335630 A1 Nov. 23, 2017

(30) Foreign Application Priority Data

May 23, 2016 (EP) ..... 16305591

(51) Int. Cl.

| | |
|---|---|
| ***E21B 10/02*** | (2006.01) |
| ***E21B 10/42*** | (2006.01) |
| ***E21B 10/48*** | (2006.01) |
| ***E21B 10/54*** | (2006.01) |
| ***E21B 10/60*** | (2006.01) |

(Continued)

(52) U.S. Cl.

CPC ..... *E21B 10/02* (2013.01); *E21B 10/42* (2013.01); *E21B 10/48* (2013.01); *E21B 10/54* (2013.01); *E21B 10/567* (2013.01); *E21B 10/602* (2013.01); *E21B 10/605* (2013.01); *E21B 17/042* (2013.01); *E21B 2010/545* (2013.01)

(58) Field of Classification Search

CPC ..... E21B 10/02; E21B 10/04; E21B 10/48; E21B 10/567; E21B 10/602; E21B 10/605; E21B 2010/545; E21B 2010/425

See application file for complete search history.

(56) References Cited

U.S. PATENT DOCUMENTS 2,256,092 A * 9/1941 Metz ..... E21B 10/04 175/263

2,738,166 A * 3/1956 Koch ..... E21B 10/04 175/333

(Continued)

FOREIGN PATENT DOCUMENTS

WO WO-2015195855 A1 * 12/2015 ..... E21B 10/605

OTHER PUBLICATIONS

EPO Search Report and Written Opinion dated Oct. 25, 2016 for EPO Application No. 16 30 5591.

*Primary Examiner* — Jennifer H Gay

(57) ABSTRACT

A drill bit includes a shank having a threaded coupling formed at an upper end thereof; a bit body mounted to a lower end of the shank and having a plenum; a gage section forming an outer portion of the drill bit; a cutting face forming a lower end of the drill bit and including: a core receptacle formed at a center of the cutting face, operable to receive a core of earth, and including: a concave core cutter mounted to a bottom of the bit body; and a core port extending from the plenum through the bottom of the bit body and operable to discharge drilling fluid onto the core and core cutter; a plurality of blades protruding from a bottom of the bit body and extending from a periphery of the core receptacle to the gage section; and a plurality of leading cutters mounted along each blade.

15 Claims, 6 Drawing Sheets

(51) Int. Cl.
*E21B 10/567* (2006.01)
*E21B 17/042* (2006.01)

(56) References Cited

U.S. PATENT DOCUMENTS 3,127,946 A * 4/1964 Deely ..... E21B 10/04 175/404
4,499,958 A * 2/1985 Radtke ..... E21B 10/55 175/428
5,655,614 A * 8/1997 Azar ..... E21B 10/04 175/404
6,209,420 B1 * 4/2001 Butcher ..... B22F 3/1055 419/28
7,392,857 B1 7/2008 Hall
7,591,327 B2 9/2009 Hall
7,617,747 B2 11/2009 Richert
7,641,002 B2 1/2010 Hall
7,661,487 B2 2/2010 Hall
7,694,756 B2 4/2010 Hall
8,020,471 B2 9/2011 Hall
8,087,478 B2 1/2012 Patel
8,130,117 B2 3/2012 Hall
8,191,656 B2 * 6/2012 Dourfaye ..... E21B 10/573 175/428
8,327,955 B2 12/2012 Patel
8,616,305 B2 12/2013 Hall
8,684,112 B2 4/2014 DiGiovanni
8,739,904 B2 6/2014 Patel
8,820,440 B2 9/2014 Hall
8,820,441 B2 9/2014 Shamburger
8,839,886 B2 * 9/2014 Jones ..... E21B 10/43 175/403
8,960,335 B2 2/2015 Hahati
2010/0218999 A1 * 9/2010 Jones ..... E21B 10/55 175/413
2010/0243334 A1 * 9/2010 Dourfaye ..... E21B 10/573 175/430
2012/0199402 A1 * 8/2012 Rupp ..... B24D 3/06 175/434
2014/0054094 A1 * 2/2014 Burhan ..... E21B 10/50 175/354
2015/0068816 A1 3/2015 Velvaluri
2015/0233186 A1 * 8/2015 Maw ..... E21B 10/43 175/432
2015/0233187 A1 * 8/2015 King ..... E21B 10/567 175/426
2015/0368976 A1 * 12/2015 Langford ..... E21B 10/605 175/57
2015/0368979 A1 12/2015 Casad
2016/0177629 A1 * 6/2016 Azar ..... E21B 10/43 175/58
2016/0281438 A1 * 9/2016 Olsen ..... E21B 10/42
2017/0234076 A1 * 8/2017 Cook, III ..... B22F 7/00 175/425
2017/0335630 A1 * 11/2017 Reboul ..... E21B 10/02

* cited by examiner

FIXED CUTTER DRILL BIT HAVING CORE RECEPTACLE WITH CONCAVE CORE CUTTER

BACKGROUND OF THE DISCLOSURE

Field of the Disclosure

The present disclosure generally relates to a fixed cutter drill bit having core receptacle with concave core cutter.

Description of the Related Art

U.S. Pat. No. 5,655,614 discloses a self-centering drill bit including a head portion having a plurality of polycrystalline diamond compact cutting elements arranged in blades that extend outwardly away from a surface of the bit. A cavity is centrally located on the head portion and is formed between adjacent blade ends. The cavity includes wall portions defined by the blade end portions. The cavity serves to house a core portion that is formed during drilling operation of the bit. The head portion is balanced to form and transmit a force from a designated wall portion to the core portion within the cavity. At least the designated wall portion includes a low friction abrasion resistant surface. The cavity includes a rigid element extending outwardly away from the head portion to reduce the core within the cavity upon contact. The force transmitted to the core portion causes a countering force to be imposed by the core to the wall portion that keeps the bit aligned with its rotational axis and, thus prevents whirling.

U.S. Pat. No. 8,820,441 discloses a drill bit having fixed Polycrystalline Diamond Compact cutters and used to drill a borehole having a core stump therein. A plurality of additional fixed Polycrystalline Diamond Compact cutters are disposed in the dome of the bit and are usable to concentrate stresses in the top end of the core stump to facilitate the cutting down of the core stump.

U.S. Pat. No. 8,839,886 discloses a drill bit configured for boring holes or wells into the earth and including a plurality of blades configured with a recessed center such that the blades cut a core therebetween. Cutting elements in the recessed center are configured to cut and remove the core. The recessed center has a first diameter at a height from the cutting elements in the recessed center and a second diameter smaller than the first diameter such that the confining stress on the core is relieved prior to being cut by the cutting elements in the recessed center.

U.S. Pat. No. 8,960,335 discloses a bit for drilling wells and having a front face with radial blades having cutting elements distributed around the front face. A space for forming a core is situated at the center of the front face. A cavity is provided for evacuating the core towards a periphery of the bit. At least a portion of the cavity is situated between adjacent blades. The cavity is delimited by two lateral surfaces and a clearance surface set back with respect to the front face, and the cavity is open in a direction opposite the clearance surface. The bit may be used in methods for drilling wells and makes it possible to rapidly drill wells of great depth in all types of rock without the risk of clogging.

U.S. Pat. No. 7,392,857 discloses a drill bit including an axis of rotation, a body, and a working face. The body includes a fluid passageway with a first seat and houses a jack element substantially coaxial with the axis. A stop element is disposed within the passageway and has a first near-sealing surface. The jack element has a shaft intermediate an indenting end and a valve portion. The valve portion has a second near-sealing surface disposed adjacent the first near-sealing surface and a second seat disposed adjacent the first seat. As a formation strongly resists the jack element, the distance between the sealing surfaces narrows. This causes an increase in fluid pressure within the passageway and forces the indenting end down into the formation. This movement of the jack element relieves the pressure build up such that the formation pushes the jack element back, thereby oscillating the jack element.

U.S. Pat. No. 7,591,327 discloses a method for drilling a bore hole including the steps of deploying a drill bit attached to a drill string in a well bore, the drill bit having an axial jack element with a distal end protruding beyond a working face of the drill bit; engaging the distal end of the jack element against the formation such that the formation applies a reaction force on the jack element while the drill string rotates; and applying a force on the jack element that opposes the reaction force such that the jack element vibrates and imposes a resonant frequency into the formation.

U.S. Pat. No. 7,641,002 discloses a rotary drag drill bit having a body intermediate a shank and a working face. The working face has a plurality of blades converging towards a center of the working face and diverging towards a gauge of the working face. A carbide section is fixed to the working face and positioned within a pocket disposed within an inverted cone of the working face. The carbide section has a distal end exposed within the working face.

U.S. Pat. No. 7,694,756 discloses a drill bit having a bit body intermediate a working face and a shank end adapted for connection to a downhole drill string. The working face has at least three fixed blades converging towards a center of the working face and diverging towards a gauge of the bit, at least one blade having a cone region adjacent the center of the working face. The cone region increases in height away from the center of the working face and towards a nose portion of the at least one blade. An opening is formed in the working face at the center of the bit along an axis of the drill bit's rotation, the opening leading into a chamber with at least one wall. An indenting member is disposed within and extends from the opening, is substantially coaxial with the axis of rotation, and is fixed to the wall of the chamber.

U.S. Pat. No. 8,020,471 discloses a drill bit having a body intermediate a shank and a working face, the working face including a plurality of blades formed on the working face and extending outwardly from the bit body. Each blade includes at least one cutting element. The drill bit also has a jack element coaxial with an axis of rotation and extending out of an opening formed in the working face. A portion of the jack element is coated with a stop-off.

U.S. Pat. No. 8,820,440 discloses a steering assembly for downhole directional drilling including an outer bit having a bore and an outer cutting area and in inner bit having an inner cutting area and connected to a shaft that is disposed within the bore. At least one biasing mechanism is disposed around the shaft. At least one fluid channel is disposed within the outer bit and redirects fluid to the at least one biasing mechanism causing the at least one biasing mechanism to push the shaft and alter an axis of the inner bit with respect to an axis of the outer bit.

U.S. Pat. No. 8,130,117 discloses a downhole drill bit with a body intermediate a shank and a working surface. Extending from the work surface is a wear resistant electric transmitter electrically isolated from the drill bit body. A wear resistant electrically conductive receiver, also electrically isolated from the bit body, may be connected to a tool string component. The working surface may also have at least two wear resistant electrodes located intermediate the transmitter and receiver that are adapted to measure an electric potential in the formation.

U.S. Pat. No. 7,661,487 discloses a downhole percussive tool including an interior chamber and a piston element slidably sitting within the interior chamber forming two pressure chambers on either side. The piston element may slide back and forth within the interior chamber as drilling fluid is channeled into either pressure chamber. Input channels supply drilling fluid into the pressure chambers and exit orifices release that fluid from the same. An exhaust orifice allows additional drilling fluid to release from the interior chamber. The amount of pressure maintained in either pressure chamber may be controlled by the size of the exiting orifices and exhaust orifices. In various embodiments, the percussive tool may form a downhole jack hammer or vibrator tool.

U.S. Pat. No. 8,191,656 discloses a cutter configured with a diamond table made from a thin hard facing material layer of polycrystalline diamond bonded to a backing layer made from cemented tungsten carbide. The face of the diamond table includes a concavity formed with a curved shape wherein at least a portion of the face in a center of the cutter is recessed with respect to at least some portion of the face about the perimeter of the cutter. This concave curved shape is formed in the diamond table itself such that the diamond table has a varying thickness depending on the implemented concavity

SUMMARY OF THE DISCLOSURE

The present disclosure generally relates to a fixed cutter drill bit having core receptacle with concave core cutter. In one embodiment, a drill bit includes a shank having a threaded coupling formed at an upper end thereof; a bit body mounted to a lower end of the shank and having a plenum; a gage section forming an outer portion of the drill bit; and a cutting face forming a lower end of the drill bit. The cutting face includes: a core receptacle formed at a center of the cutting face, operable to receive a core of earth, and including: a concave core cutter mounted to a bottom of the bit body; and a core port extending from the plenum through the bottom of the bit body and operable to discharge drilling fluid onto the core and core cutter; a plurality of blades protruding from a bottom of the bit body and extending from a periphery of the core receptacle to the gage section; and a plurality of leading cutters mounted along each blade.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
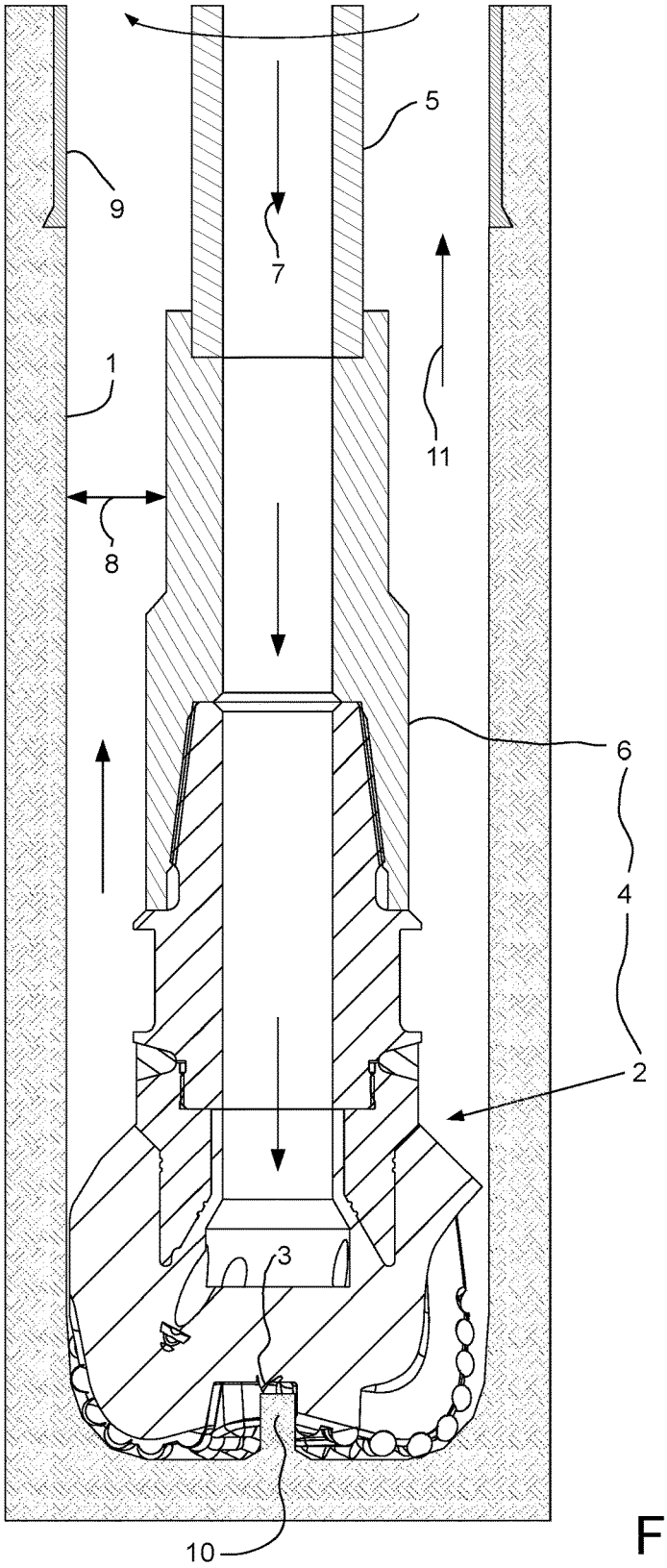
FIG. 1 illustrates drilling of a wellbore with a drill bit having a core cutter, according to one embodiment of the present disclosure.
Figure 2A:
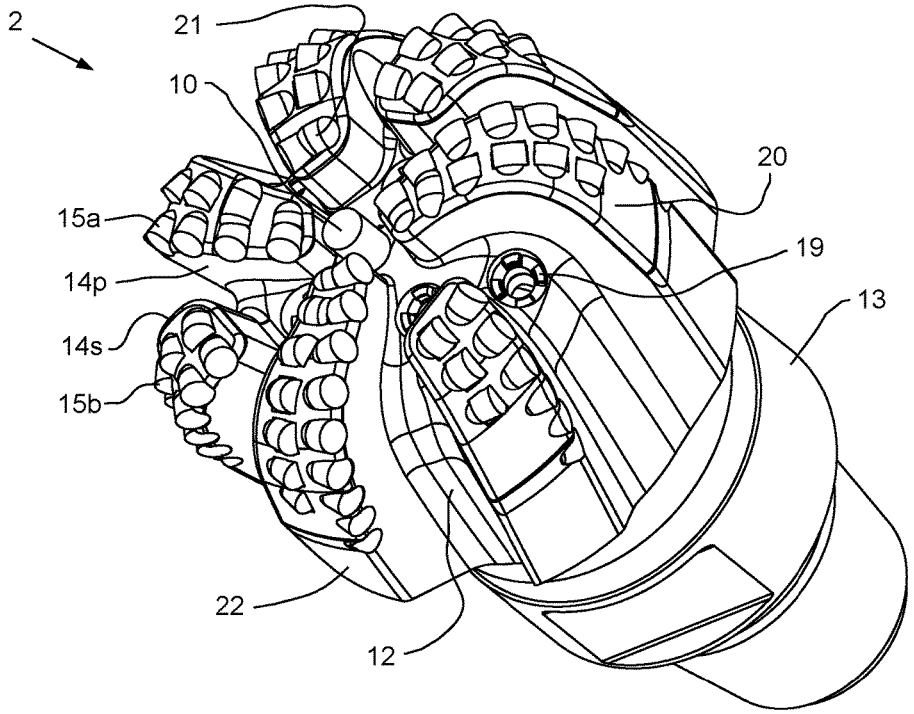
FIGS. 2A, 2B, and 3A-3C illustrate the drill bit having the core cutter engaged with the core.
Figure 2B:
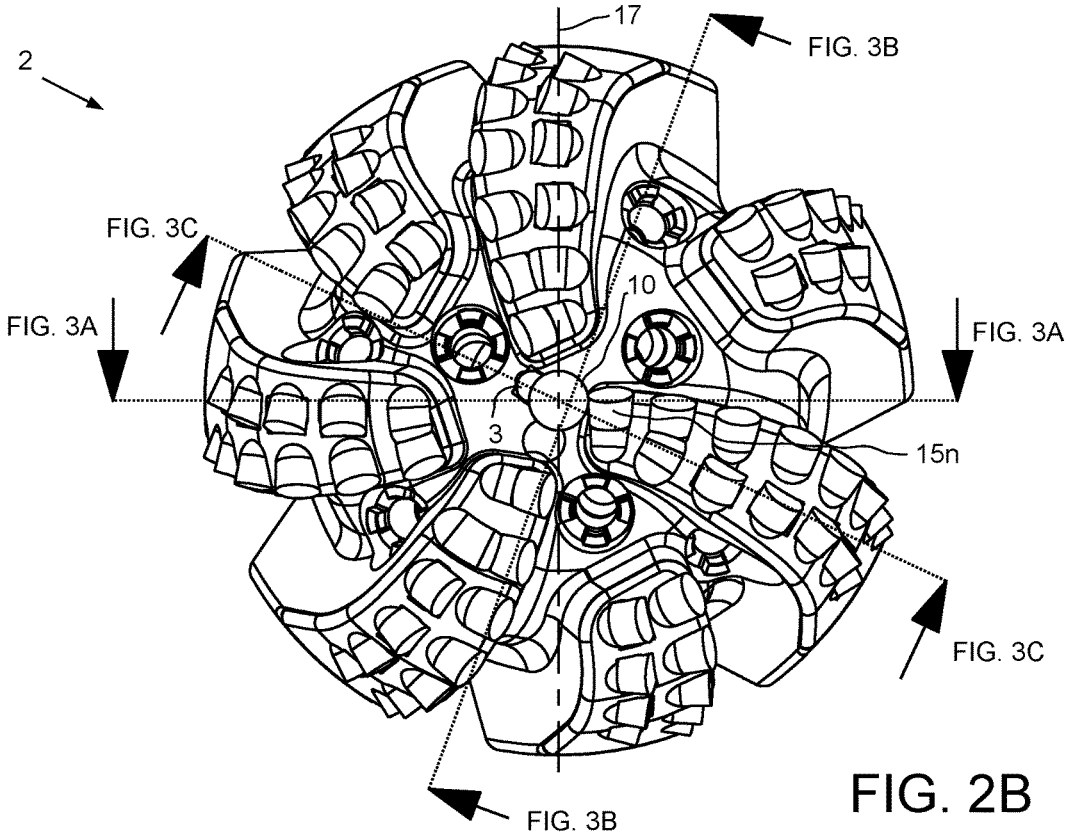

FIG. 1 illustrates drilling of a wellbore 1 with a drill bit 2 having a core cutter 3, according to one embodiment of the present invention. The drill bit 2 may be assembled as part of a bottomhole assembly (BHA) 4. The BHA 4 may be connected to a bottom of a pipe string 5, such as drill pipe or coiled tubing, and deployed into the wellbore 1, thereby forming a drill string. The BHA 4 may further include one or more drill collars 6 connected to the drill bit 2, such as by threaded couplings. The drill bit 2 may be rotated, such as by rotation of the drill string from a rig (not shown) and/or by a drilling motor (not shown) of the BHA 4, while drilling fluid 7, such as mud, may be pumped down the drill string. Weight of the drill string may be set on the drill bit 2. The drilling fluid 7 may be discharged by the drill bit 2 and carry cuttings up an annulus 8 formed between the drill string and the wellbore 1 and/or between the drill string and a casing string and/or liner string 9. As the wellbore 1 is being drilled, a cylindrical core 10 of earth is formed and is received by a center of the drill bit 2. A top of the core 10 is ground and broken apart by the core cutter 3 and the core cuttings are also carried up the annulus 8 by the discharged drilling fluid 7. The drilling fluid and cuttings are collectively referred to as returns 11.

Figure 3A:
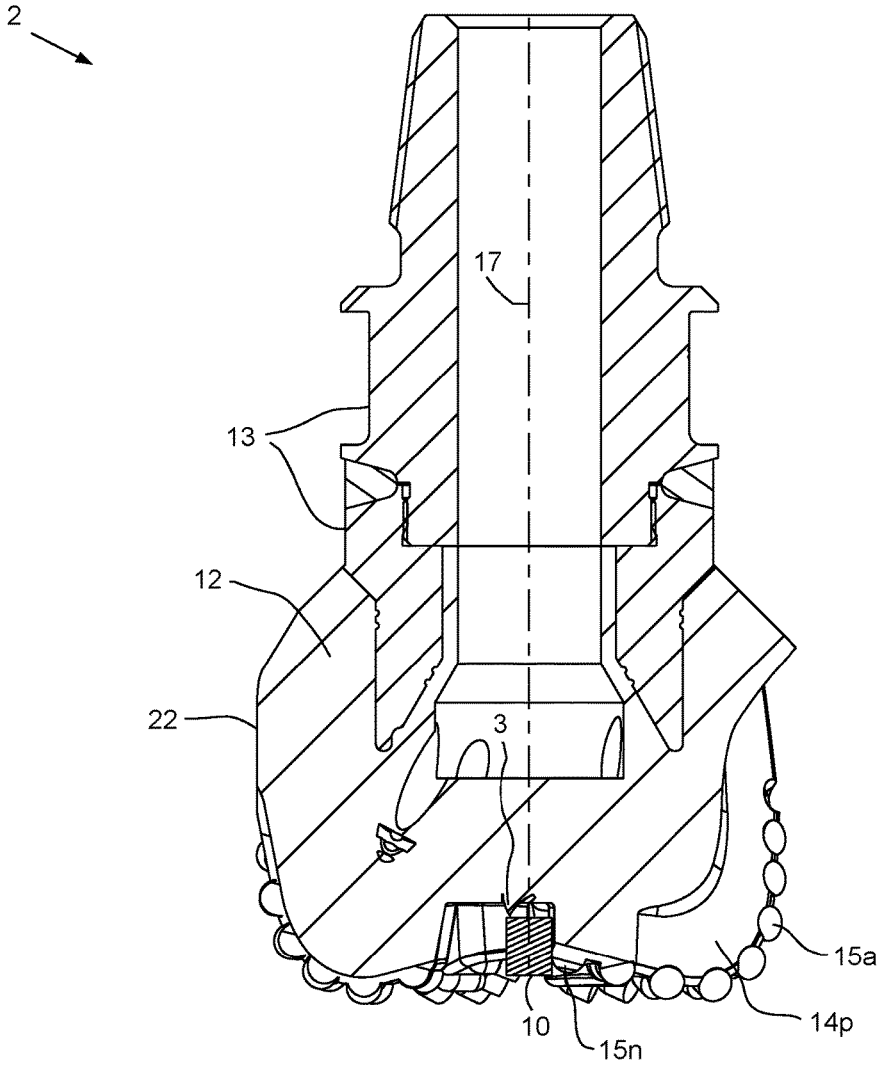
Figure 3B:
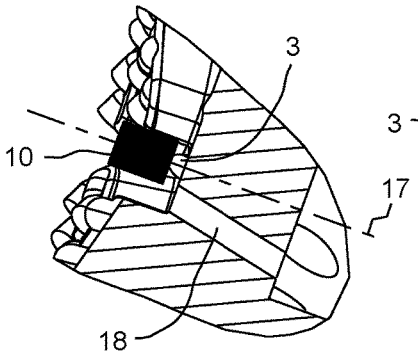
Figure 3C:
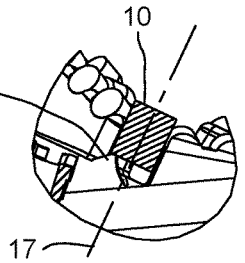
Figure 3D:
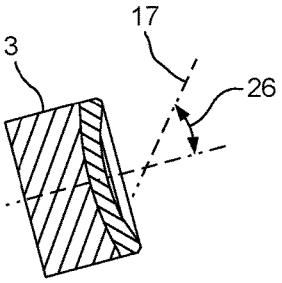
FIG. 3D illustrates a tilt angle of the core cutter.
Figure 4A:
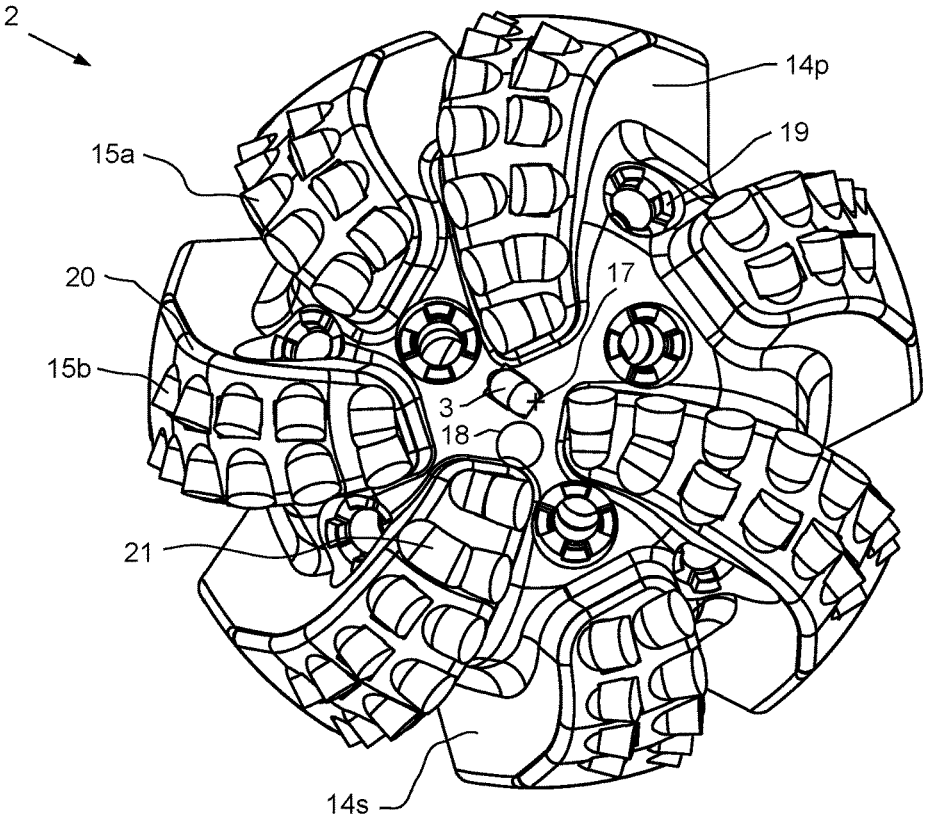
FIG. 4A illustrates a cutting face of the drill bit.
Figure 4B:
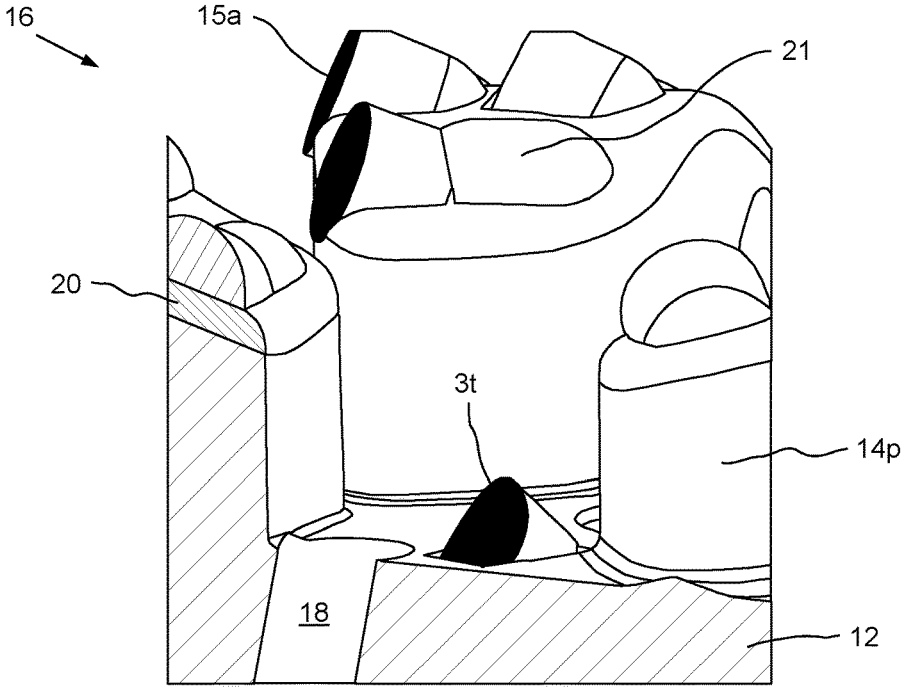
FIG. 4B illustrates a core receptacle of the drill bit.

FIGS. 2A, 2B, and 3A-3C illustrate the drill bit 2 having the core cutter 3 engaged with the core 10. FIG. 3D illustrates a tilt angle 26 of the core cutter 3. FIG. 4A illustrates a cutting face of the drill bit 2. FIG. 4B illustrates a core receptacle of the drill bit 2. The drill bit 2 may include a bit body 12, a shank 13, a cutting face, and a gage section. The shank 13 may be tubular and include an upper piece and a lower piece connected to the upper piece, such as by threaded couplings secured by a weld. The bit body 12 may be made from a composite material, such as a ceramic and/or cermet body powder infiltrated by a metallic binder. The bit body 12 may be mounted to the lower shank piece during molding thereof. The shank 13 may be made from a metal or alloy, such as steel, and have a coupling, such as a threaded pin, formed at an upper end thereof for connection of the drill bit 2 to the drill collar 6. The shank 13 may have a flow bore formed therethrough and the flow bore may extend into the bit body 12 to a plenum thereof. The cutting face may form a lower end of the drill bit 2 and the gage section may form at an outer portion thereof.

Alternatively, the bit body 12 may be metallic, such as being made from steel, and may be hardfaced. The metallic bit body may be connected to a modified shank by threaded couplings and then secured by a weld.

The cutting face may include one or more (three shown) primary blades 14*p*, one or more (four shown) secondary blades 14*s*, fluid courses formed between the blades, leading cutters 15*a*, backup cutters 15*b*, and a core receptacle 16. The core receptacle 16 may be a bladeless region formed at a center 17 of the cutting face. The core receptacle 16 may be configured to receive the core 10 having a diameter ranging between four to seventeen percent of an outer diameter of the drill bit 2. The diameter of the core 10 may be controlled by a position of an innermost one 15*n* of the leading cutters 15*a*.

The core receptacle 16 may be defined between inner ends of the primary blades 14*p* and include the core cutter 3 and a core port 18. The core cutter 3 may be mounted in a pocket formed in the bottom of the bit body 12, such as by brazing. The core port 18 may be formed in the bit body 12 and may extend from the plenum and through the bottom of the bit body to discharge drilling fluid onto the core 10 and core cutter 3, thereby facilitating crushing of the core by the core cutter and washing cuttings therefrom. The core port 18 may include a nozzle (not shown) fastened to the bit body 12 or be nozzle-less (shown). A diameter of the core cutter 3 may be selected and the core cutter may be tilted 26 relative to the longitudinal centerline 17 of the drill bit 2 such that a cutting table 3*t* thereof overlaps a portion of the core diameter, such as ranging between one-quarter to one-half of the core diameter, thereby ensuring complete crushing thereof as the core cutter rotates with the drill bit 2. The tilt angle 26 may range between ten and fifty degrees. The diameter of the core cutter 3 may range between one-half and three-halves of the diameter of the core 10. The core cutter 3 may be slightly offset from the center 17 of the cutter face such that a bottom of the cutting table 3*t* is adjacent to an outer surface of the core 10 and/or an edge of the core cutter pocket may intersect the center 17 of the cutter face. The core receptacle 16 may be in fluid communication with the fluid courses. A bottom of the core cutter 3 may be sub-flush with a bottom of the primary blades 14*p* and may be substantially sub-flush therewith, such as being sub-flush with a mid-line of the primary blades.

The blades 14*p,s* may be disposed around the cutting face and each blade may be formed during molding of the bit body 12 and may protrude from the bottom of the bit body. The primary blades 14*p* may each extend from a periphery of the core receptacle 16 to the gage section. One or more (seven shown) blade ports may be formed in the bit body 12 and each blade port may extend from the plenum and through the bottom of the bit body to discharge drilling fluid along the fluid courses. A nozzle 19 may be disposed in each blade port and fastened to the bit body 12. An inner set of one or more (three shown) of the blade ports may be disposed adjacent to respective inner ends of the primary blades 14*p*. The secondary blades 14*s* may extend from a location on the cutting face adjacent to the inner set of blade ports to the gage section. Each blade 14*p,s* may extend generally radially from the cutting face to the gage section with a slight spiral curvature.

A base of each blade 14*p,s* and a mid-portion of each blade may be made from the same material as the bit body 12. A lower tip 20 of each blade 14*p,s* may impregnated with a superhard material, such as diamond, to enhance abrasion resistance. The leading cutters 15*a* may be mounted in pockets formed along leading edges of the blades 14*p,s*, such as by brazing. The backup cutters 15*b* may be mounted in pockets formed along bottoms of the blades 14*p,s*, such as by brazing. Each backup cutter 15*b* may be aligned or slightly offset from a respective leading cutter 15*a*. The backup cutters 15*b* may or may not fully extend to the gage section. Each cutter 15*a,b* may include a superhard cutting table, such as polycrystalline diamond, attached to a hard substrate, such as a cermet, thereby forming a compact, such as a polycrystalline diamond compact. The innermost pocket or pair of pockets of each primary blade 14*p* in the bottom thereof may have wear segments 21 instead of backup cutters 15*b*. Each wear segment 21 may be impregnated with a superhard material, such as diamond, to enhance abrasion resistance.

The gage section may include a plurality of gage pads 22 and junk slots formed between the gage pads. The junk slots may be in fluid communication with the fluid courses formed between the blades 14*p,s*. The gage pads 22 may be disposed around the gage section and each pad may be formed during molding of the bit body 12 and may protrude from the outer portion of the bit body. Each gage pad 22 may be made from the same material as the bit body and each gage pad may be formed integrally with a respective blade 14*p,s*.

Figure 5A:
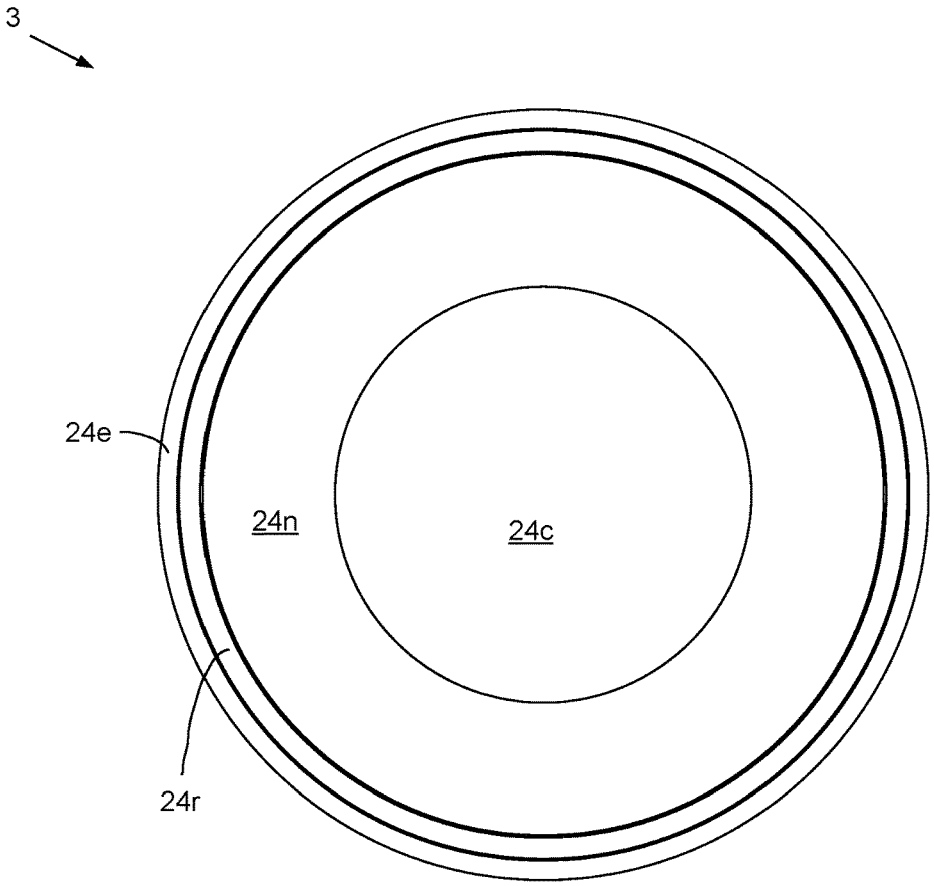
FIGS. 5A and 5B illustrate the core cutter of the drill bit.
Figure 5B:
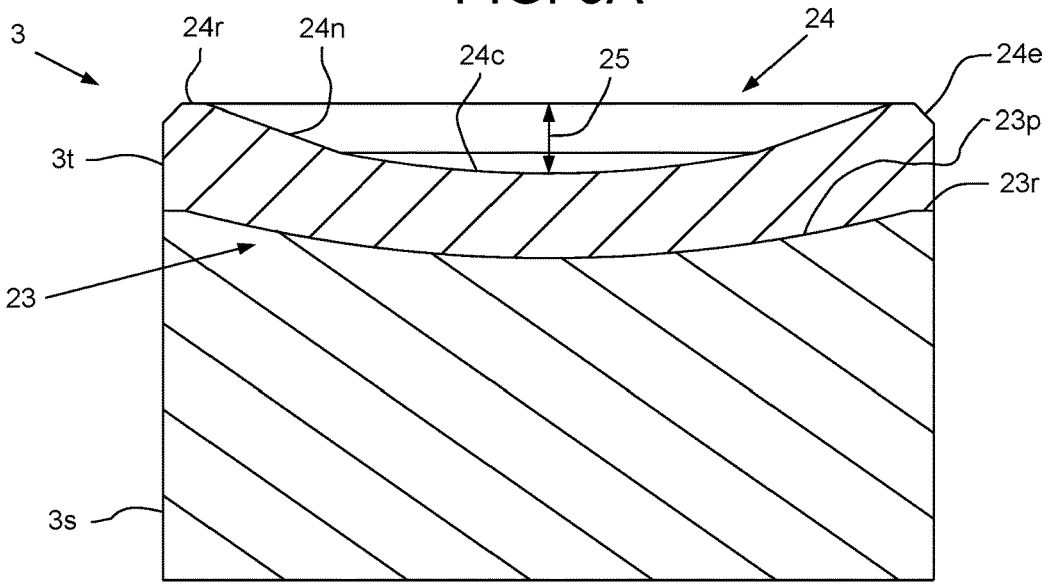

FIGS. 5A and 5B illustrate the core cutter 3. The core cutter 3 may include the concave cutting table 3*t* attached to a cylindrical substrate 3*s*. The concave cutting table 3*t* may be circular and the substrate 3*s* may be a circular cylinder. The cutting table 3*t* may be made from a superhard material, such as polycrystalline diamond, attached to a hard substrate, such as a cermet, thereby forming a compact, such as a polycrystalline diamond compact. The cermet may be a cemented carbide, such as cobalt (or group VIII metal)-tungsten carbide. The cutting table 3*t* may have an interface 23 with the substrate 3*s* and a cutting face 24 opposite to the interface. The cutting face 24 may have an outer chamfered edge 24*e*, a planar rim 24*r* adjacent to the chamfered edge, a conical surface 24*n* adjacent to the rim, and a central crater 24*c* adjacent to the conical surface 24*c*. The interface 23 may have a planar outer rim 23*r* and an inner parabolic surface 23*p*. The thickness of the cutting table 3*t* may be a minimum at the crater 24*c* and increase outwardly therefrom until reaching a maximum at the rim 23*r*. A depth 25 of the concavity may range between four percent and eighteen percent of a diameter of the core cutter 3.

Alternatively, the cutting table 3*t* and substrate 3*s* may each be elliptical.

Cutting efficiency may be problematic at the center of fixed-cutter bits due to the low linear speed. Advantageously, the concave core cutter 3 will smoothly crush the core 10 utilizing both shear forces and lateral forces in order to break the core apart and crush it. This dual action cutting is superior to any of the prior art solutions, discussed above. Also, to be clear, even though the core 10 is created during drilling, the drill bit 2 is not a coring bit, as the core is destroyed by the core cutter 3 and cuttings therefrom are washed along the fluid courses and junk slots.

Figure 6:
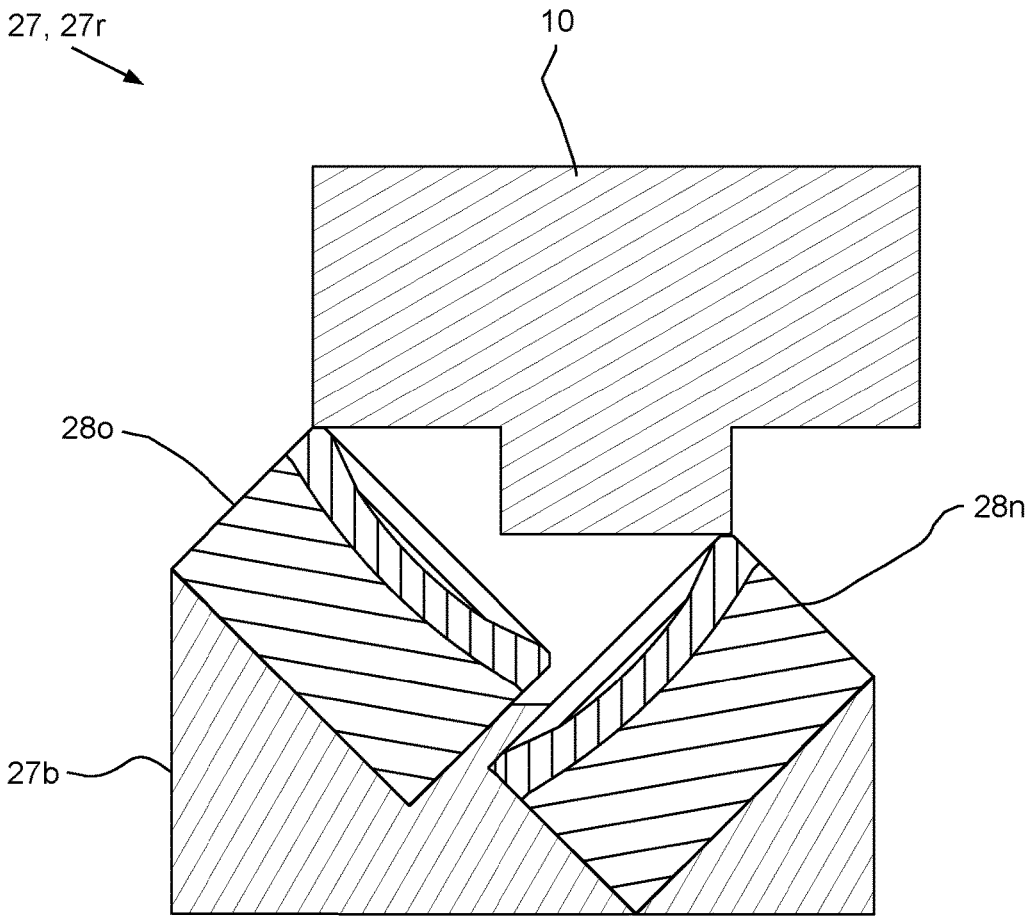
FIG. 6 illustrates an alternative drill bit having a dual cutter receptacle, according to another embodiment of the present disclosure.

FIG. 6 illustrates an alternative drill bit 27 having a dual cutter receptacle 27*r*, according to another embodiment of the present disclosure. The alternative drill bit 27 may be similar to the drill bit 2 except for having the dual cutter receptacle 27*r* instead of the core receptacle 16 and having a modified bit body 27*b* for accommodating the dual cutter receptacle. The dual cutter receptacle 27*r* may include an outer core cutter 28*o*, an inner core cutter 28*n*, and the core port (not shown). Each core cutter 28*n,o* may be similar to the core cutter 3. Each core cutter 28*n,o* may be mounted in a respective pocket formed in the bottom of the modified bit body 27*b*. The core cutters 28*n,o* may be angularly spaced from each other about the alternative core receptacle 27*r*, such as by a spacing ranging between thirty and one hundred eighty degrees. A bottom of each core cutter 28*n,o* may be sub-flush with a bottom of the primary blades (not shown). The outer core cutter 28*o* may extend from the bottom of the modified bit body 27*b* at a height greater than a height that the inner core cutter 28*n* extends from the bottom of the modified bit body. A cutting table of the outer core cutter 28*o* may overlap with an outer portion of the core 10 and a cutting table of the inner core cutter 28*n* may overlap with an inner portion of the core such that the core is cut in two stages. The two-stage cut may give the core 10 a tiered shape within the alternative core receptacle 27*r*.

Alternatively, the alternative drill bit 27 may have more than two core cutters 28*n,o*, such as a number of core cutters greater than or equal to the number of primary blades, such as three, or greater than or equal to the number of total blades (primary+secondary), such as seven.

While the foregoing is directed to embodiments of the present disclosure, other and further embodiments of the disclosure may be devised without departing from the basic scope thereof, and the scope of the invention is determined by the claims that follow.

The invention claimed is:

1. A drill bit, comprising:

a shank having a threaded coupling formed at an upper end thereof;

a bit body mounted to a lower end of the shank and having a plenum;

a gage section forming an outer portion of the drill bit; and a cutting face forming a lower end of the drill bit and comprising:

a core receptacle formed at a center of the cutting face, operable to receive a core of earth, and comprising:

a concave core cutter mounted to a bottom of the bit body and operable to destroy the core; and a core port extending from the plenum through the bottom of the bit body and operable to discharge drilling fluid onto the core and core cutter;

a plurality of blades protruding from the bottom of the bit body and extending from a periphery of the core receptacle to the gage section; and a plurality of leading cutters mounted along each blade, wherein:

the core cutter is mounted in a pocket formed in the bottom of the bit body, and an edge of the pocket intersects the center of the cutting face.

2. The bit of claim 1, wherein an innermost one of the leading cutters is positioned such that a diameter of the core ranges from four to seventeen percent of an outer diameter of the drill bit.

3. The bit of claim 1, wherein the concave core cutter overlaps with a portion of a diameter of the core ranging between one-quarter and one-half thereof.

4. The bit of claim 1, wherein the concave core cutter is tilted relative to a centerline of the drill bit by an angle ranging between ten and fifty degrees.

5. The bit of claim 1, wherein a diameter of the concave core cutter ranges between one-half and three-halves of a diameter of the core.

6. The bit of claim 1, wherein a bottom of the concave core cutter is within the core receptacle.

7. The bit of claim 1, wherein a depth of the concavity ranges between four percent and eighteen percent of a diameter of the concave core cutter.

8. The bit of claim 1, wherein the drill bit comprises only one concave core cutter.

9. The bit of claim 1, wherein:

the core cutter is a first core cutter, and the bit further comprises a second concave core cutter mounted to the bottom of the bit body.

10. The bit of claim 9, wherein the core cutters are angularly spaced from each other about the core receptacle ranging between thirty and one hundred eighty degrees.

11. The bit of claim 9, wherein:

the first core cutter is an inner core cutter, the second core cutter is an outer core cutter, a bottom of each core cutter is within the core receptacle, the outer core cutter extends from the bottom of the bit body at a height greater than a height that the inner core cutter extends from the bottom of the bit body, and a cutting table of the outer core cutter overlaps with an outer portion of the core and a cutting table of the inner core cutter overlaps with an inner portion of the core such that the core cutters are operable to cut the core in two stages.

12. The bit of claim 1, wherein:

the bit has at least three blades, and the core receptacle further comprises at least two additional concave core cutters.

13. The bit of claim 1, wherein the bit body is made from a ceramic and/or cermet powder infiltrated by a metallic binder.

14. The bit of claim 1, wherein:

lower tips of the blades are impregnated with a superhard material, and the bit further comprises one or more superhard wear elements mounted to a bottom of each blade adjacent an inner end thereof, each wear element trailing a respective cutter.

15. A method of drilling a wellbore using the drill bit of claim 1, comprising:

connecting the drill bit to a bottom of a pipe string, thereby forming a drill string;

lowering the drill string into the wellbore until the drill bit is proximate a bottom thereof;

rotating the drill bit and injecting drilling fluid through the drill string; and exerting weight on the drill bit, wherein the concave core cutter destroys the core utilizing both shear forces and lateral forces in order to break the core apart and crush the core.

* * * * *